US010438483B2

(12) United States Patent
Free

(10) Patent No.: US 10,438,483 B2
(45) Date of Patent: Oct. 8, 2019

(54) MOBILE "FAST LANE ON WARNING" (FLOW) OUTPUT READOUT AND MOBILE-SEQUENCER FEATURES FOR GREEN LIGHT SCHEDULING

(76) Inventor: James Jacob Free, Elkhart, IN (US)

( * ) Notice: Subject to any disclaimer, the term of this patent is extended or adjusted under 35 U.S.C. 154(b) by 425 days.

(21) Appl. No.: 12/589,793

(22) Filed: Oct. 27, 2009

(65) Prior Publication Data

US 2010/0117861 A1 May 13, 2010

Related U.S. Application Data

(60) Provisional application No. 61/197,343, filed on Oct. 27, 2008.

(51) Int. Cl.
*G08G 1/07* (2006.01)
*G08G 1/01* (2006.01)

(52) U.S. Cl.
CPC ..... *G08G 1/07* (2013.01); *G08G 1/0104* (2013.01)

(58) Field of Classification Search
CPC ..... G08G 1/08; G08G 1/081; G08G 1/096; G08G 1/087; G08G 1/07; G08G 1/00; G08G 1/0104; G08G 1/096725; G08G 1/096783
USPC ..... 340/907, 917, 929, 932; 901/150; 701/150
See application file for complete search history.

(56) References Cited

U.S. PATENT DOCUMENTS 3,302,168 A 1/1967 Gray
3,522,984 A 9/1970 Villemain
3,544,959 A 12/1970 Hawks
3,750,099 A 7/1973 Proctor
3,872,423 A 7/1975 Yeakley
4,167,785 A * 9/1979 McReynolds ..... G08G 1/082 340/911
RE31,044 E * 9/1982 McReynolds ..... G08G 1/082 340/913
5,278,554 A * 1/1994 Marton ..... G08G 1/081 340/909

(Continued)

OTHER PUBLICATIONS

Free, James Paper Published at Intelligent Transportation Society of America Jun. 3, 2009.

*Primary Examiner* — Hoi C Lau

(57) ABSTRACT

An invention regarding traffic management "Fast Lane On Warning" (FLOW) is disclosed whereby individual vehicles are informed and told what speed to go in order to pass through a traffic signal while the light is green. A converging, consolidating traffic managing "fast lane on warning" director sequencer works in conjunction with a traffic signal sequencer (commonly known in the art), both of which have the same service cycle period Pi. The (RGY) type phases and readout phases are set for each unique particular intersection. While the traffic sequencer controls repeating RGY cycles, the director sequencer instructs, generates, transmits repeating cycles of changeable readouts on one or more roadside unit (RSU) emplacements positioned up the road from the traffic signal for one or more lanes in one or more directions. These changing speed assignments or readouts, individually perceived by motorists, guide in motorists such that by the time they pass through the intersection, they will do so while the traffic signal is green, regardless of any random pattern of traffic individual motorists may have been in as they approached the emplacements.

18 Claims, 10 Drawing Sheets

(56) References Cited

U.S. PATENT DOCUMENTS 5,283,573 A * 2/1994 Takatou ..... G08G 1/08 340/934
5,330,278 A 7/1994 Raswant
5,798,949 A * 8/1998 Kaub ..... G08G 1/164 703/6
5,959,553 A 9/1999 Raswant
6,188,778 B1 * 2/2001 Higashikubo ..... G08G 1/04 340/934
6,424,271 B2 7/2002 Raswant
6,489,920 B1 * 12/2002 Anders ..... G08G 1/04 340/934
7,573,400 B2 * 8/2009 Arnold ..... G01S 13/34 340/907
7,663,505 B2 * 2/2010 Publicover ..... G08G 1/095 340/932
7,991,542 B2 * 8/2011 Giles ..... G08G 1/07 340/907
8,050,854 B1 * 11/2011 Chandra ..... G08G 1/07 340/917
2002/0059017 A1 * 5/2002 Yamane ..... G08G 1/0104 701/1
2002/0116118 A1 * 8/2002 Stallard ..... G08G 1/01 701/117
2005/0140523 A1 * 6/2005 Publicover ..... G08G 1/095 340/907
2006/0155427 A1 * 7/2006 Yang ..... G08G 1/07 701/1
2007/0176791 A1 * 8/2007 Bolotin ..... G08G 1/096 340/929
2007/0222639 A1 * 9/2007 Giles ..... G08G 1/0104 340/907
2008/0012726 A1 * 1/2008 Publicover ..... G08G 1/095 340/932
2008/0030372 A1 * 2/2008 Lu ..... G08G 1/096 340/929
2008/0094250 A1 * 4/2008 Myr ..... G08G 1/04 340/909
2009/0005984 A1 * 1/2009 Bradley ..... G01C 21/20 701/469
2009/0224942 A1 * 9/2009 Goudy ..... G08G 1/096783 340/905
2009/0256721 A1 * 10/2009 Glatfelter ..... G08G 1/01 340/907
2010/0117861 A1 * 5/2010 Free ..... G08G 1/07 340/929
2010/0164753 A1 * 7/2010 Free ..... G08G 1/096725 340/932
2010/0191449 A1 * 7/2010 Iwamoto ..... G08G 1/08 701/118
2011/0175753 A1 * 7/2011 Free ..... G08G 1/08 340/917
2011/0248868 A1 * 10/2011 Free ..... G08G 1/0104 340/907

* cited by examiner

RED
GREEN
YELLOW
SPEED ASSIGNMENT
LOW
HIGH
OFFSET
OFFSET
R
A
Pi(0)
Pi(1)
Pi(2)
Pi(3)
Pi
2
6
8
10
11
12
13
14
16
18
20
22

MOBILE "FAST LANE ON WARNING" (FLOW) OUTPUT READOUT AND MOBILE-SEQUENCER FEATURES FOR GREEN LIGHT SCHEDULING

This application claims further benefit to Provisional Application No. 61,197,343 filed Oct. 27, 2008

STATEMENT REGARDING FEDERALLY FUNDED RESEARCH AND DEVELOPMENT

Not Applicable

REFERENCES

U.S. Pat. No. 3,302,168 January 1967 Gray 340/932
U.S. Pat. No. 3,529,284 September 1970 Villemain 340/942
U.S. Pat. No. 3,544,959 December 1970 Hawks 340/942
U.S. Pat. No. 3,750,099 July 1973 Proctor 340/932
U.S. Pat. No. 3,872,423 July 1975 Yeakley 340/932
U.S. Pat. No. 5,278,554 Jan. 11 1994 Marton 340/942
U.S. Pat. No. 5,959,553 Sep. 28, 1999 Raswant, 340/907
U.S. Pat. No. 5,821,878 October 13,1998 Raswant 340/907
U.S. Pat. No. 5,330,278 Jul. 19, 1994 Raswant 404/1
U.S. Pat. No. 6,424,271 Jul. 23, 2002 Raswant 340/907
Free, James Paper Published at Intelligent Transportation Society of America Jun. 3, 2009

FIELD

This invention relates to increased mobility in traffic, systems that autonomously schedule and tell vehicles how fast to go to get through green phase, green waves for bi-directional traffic in perpendicular directions where groups take turns going through green phase.

BACKGROUND

Due to the increasingly precious fuel supply, and at a time where the effects of emissions are more profoundly felt, efforts to guide traffic through a signaled intersection while the light is green are becoming increasingly attractive. Allowing vehicles to remain in the high energy state are the best way to reduce the national fuel consumption rate. A vehicle that does not have to re-accelerate from a stop will save much more fuel and emit much less pollution than those that do have to come to a complete stop and reaccelerate back up to the traveling speed.

Many inventions anticipate that there could be a "platoon" or a "convoy" or moving traffic-filled zone that approaches the traffic signal at constant velocity such that the vehicles that get in the green zone make it through the light while it is green. Examples are to be implied in Gray (U.S. Pat. No. 3,302,168), et al, 1967, Proctor (U.S. Pat. No. 3,750,099) July 1973, Yeakley (U.S. Pat. No. 872,423) March 1975, theoretically laid out by Villemain, (U.S. Pat. No. 3,529,284) September 1970.

In these references, there is no real way the traffic is formed or organized, other than the informal identification of where a green zone is. There is no coordinated effort to position the traffic somewhat in the same relative position it had been in when it approached the area before the intersection where traffic should be organized. The references show no means to consolidate or compress the traffic from a previously random constant stream of traffic into that zone of somewhat constant velocity (for that matter, of any average, or any aggregate velocity and also one that cannot exceed speed limit) that goes through during the green.

While the green zone indeed qualifies for the possibility for keeping vehicles in the high energy state, and thus saving fuel and reducing emissions, the inventions mentioned above may promote speeding. If there is a perceivable way to get into a green zone, the vehicles could easily exceed, and in some cases would have to exceed the speed limit to gain access to the green zone ahead, thereby creating a dangerous situation. In the case of Marton (U.S. Pat. No. 5,278,554 Jan. 11 1994), Raswant (U.S. Pat. No. 5,959,553 Sep. 28, 1999; U.S. Pat. No. 5,821,878 Oct. 13, 1998, U.S. Pat. No. 5,330,278 Jul. 19, 1994; U.S. Pat. No. 6,424,271 Jul. 23, 2002), management for a lane is anticipated as well as opposing (perpendicular) direction being taken into account. There is a "travel" zone" that is identified only as a green zone approaching the intersection leaving out any information for motorists in the middle of a green zone. Are they at the beginning of it? The end of it? Are they gaining, i.e. coming from the back of the pattern or "platoon" to the front? With Marton, as well as others, the traffic will build up on either end of the green zone. What is especially dangerous, is that traffic would build up and crowd in on the trailing part of a green zone where it had to exceed the speed limit in order to get there. So not only would traffic bunch up at too large of an amount too rapidly, it would also do it at a speed greater than the speed limit. An infrastructure difficulty with Villimon, Hawkes (U.S. Pat. No. 3,544,959 December 1970), Marton et al is the coordination of moving pattern of switching lights along with what may turn out as a large amount of power to run them. Also, it would be very expensive to operate. With these inventions, there is a "processor" but none of them describes the details of how traffic is safely gathered in a green phase.

For many years, the timing of traffic lights, especially on one way streets has allowed for more mobility by the traffic not having to stop. As long as vehicles knew what speed to go, they would be able to make a series of green lights. This timing and synchronization, has taken different forms and is often referred to as a "Green Wave". Traffic travelling under this condition could provide mobility, save fuel, reduce emissions. The challenge with a Green Wave is its limited use. It works in essentially only one direction and it the signals must be appropriately oriented i.e. be multiple, fairly evenly spaced, and so on, in order for it to be applicable. A green wave would not work for first encountered traffic signals and signals that are far enough apart that they could be qualified as first encountered. It does not work for traffic going in opposite directions on the same road; i.e. bi-directional. Green Wave will also not be effective in essentially isolated signals or signals far enough apart that they could be treated as isolated. Green wave would not work for green patterns to take turns going through the green for opposing (perpendicular) directions such as E-W, and N-S for the same signal. More straightforward green wave applications would be for one way streets laid out essentially parallel to one another (i.e. N-S streets only or E-W streets only). Attempts at Green Wave going in opposite (perpendicular) directions including more complex examples are to be found in Marton 1994, Rawswant 1994, 1998, 1999, 2002 which identify a green zone in a block by block grid in a city including "checkerboard patterns and alternating bands". While a green wave could also function in a block by block grid in a city, they work most reliably and autonomously as one way streets. Green wave attempts for opposite (perpendicular) directions that may involve block by block scenarios get more complex and may provide a diminishing return of mobility at higher complexity, less reliability, less dependability, and less safety; i.e. becoming more dangerous.

The first necessity of traffic management in getting through during the green phase for first-encountered signals is to convey some kind of instructions to the individual motorist. While Villemain, Hawkes, Marton, Raswant, et al all identify some kind of green zone, as well as "vacated area", these inventions lack (along with a method of safely consolidating traffic) any kind of clear way instruct the traffic to go into the green zone. There is no method or parameters that they provide, and any idea that they do have is detrimental to safety in a sense that they encourage speeding to catch up with a green zone.

While green wave will not work for conditions of first encountered, or far apart encountered, my invention will work these conditions, as well as a tool that enhances green wave and approaches to green wave systems. My invention will also be able to serve as a tool that unite different systems with one another, and provide even more mobility. Using readouts as described in my invention could effectively instruct individual motorists and also work effectively as a tool for enhancing and clarifying complex inner city algorithms as discussed above.

SUMMARY OF THE INVENTION INCLUDING OBJECTS OF INVENTION

In truly considering the managing of incoming traffic for the purposes of telling traffic what speed to go in order to make it through the green phase of a traffic signal, this invention will establish the paradigm of Fast Lane On Warning: FLOW. For bringing traffic through the light while it is green, one must always consider the equation:

$$\frac{\partial V}{\partial t} = \frac{\frac{\partial X}{\partial t}}{\frac{\partial T}{\partial X}}$$

which essentially grows from the equation (V=X/t),where X is position (how far from the intersection), V is speed, t is time. The equation denotes change in each of the original variables it grew out of: V, X, t, and it reads as: "The variation of speed with respect to real time is equal to the variation of length to intersection with respect to real time per the variation of time left in the RGY sequence with respect to the variation of length to the intersection." Further, there are basic, underlying, required parameters that must be considered when managing traffic for the purposes of telling traffic what speed to go in order to make it through a traffic signal while it is in green phase. they are:

1. That the speed limit cannot be exceeded by vehicles as a function of speed assignments or readouts that vehicles getI
2. That vehicles must not be cross-assigned as a function of readouts; they cannot be instructed per speed assignments or readouts to pass one another in any management conditions.
3. That, as a further consideration in "no cross-assigning . . . passing", and to prevent bunching up, vehicles should retain the same general proportion in a hierarchy while they are going through the green phase that they had in a hierarchy before any traffic management occurred. In other words, a vehicle leading a group or FLOW pattern while proceeding through a green light would have started out leading that same group just before any traffic management (or "consolidation; compression" per time) occurred. The same would go for a vehicle arriving in pre-consolidation 74% into the FLOW pattern, and thus pretty much 74% into a FLOW pattern as it went through a green traffic light, and essentially 74% into that "net" green phase as well.

In addition to these three basic parameters, there should be an option for safety buffer time periods that translate into physical safety zones that are possible for both the beginning and end of a "net" green zone as well as time period.

While the value for the above equation in guiding and forming traffic into a green zone or FLOW pattern is minimal, a SOLUTION for the above is very important.

That solution, which also grows out of V, X and t is:

$$Vsa = \frac{X}{(Pi - Pa) + Pi + pgS - \left[1 - \frac{(Pi - Pa)}{Pi}\right]Tng}$$

where:

Vsa is output of speed assignment,

X is position or distance to the traffic signal, pgS is a safety buffer time period where earlier arrivals can be accounted for that also results in a safety "extra" following distance, Pi is service cycle of the traffic signal, Pa is arrival point in time where X is taken, Pi >Pa >0

Pi and Pa are an arrival function that counts down every repetition of the service cycle. There can also be a safety following buffer initiated by further shrinking Tng so that a Psf; safety following time buffer can be Psf=G −Tng−pgS The use of this solution/relation is applied to FLOW traffic management through the use of a FLOW sequencer that may have its own timer, but would take its cue from the sequencer that runs the traffic signal. Also the FLOW sequencer outputs readouts for one or multiple FLOW lanes in one or more directions into roadside units (RSU), or emplacements. An optimum choice of where to locate these emplacements would have to include being at a "node" (borrowing a term from wave physics) which would be a distance of Pi*speed limit. The node, which has other definitions as well, is a place where there are no "voids" or "blind spots", "empty space" ("vacated areas" in other references), but instead a place where a complete set of speed assignments that repeat themselves throughout each repeating Pi would be. Thus, vehicles driving by a roadside emplacement at a node will always see some kind of readout that will guide them through the intersection somewhere during the green phase and if safety applications (i.e. safety time buffer periods) are in place, somewhere in the "net" green phase.

Multiple readouts that are emplaced among these void times and places (within X) could serve two main purposes. First, they may help to enhance resolution not only visual resolution which is important, but speed outputs per time resolution and arrival times within the Tng resolution. If there are multiple readout emplacements, a late or early few seconds within Tng hierarchy place could be "corrected" and the vehicle could more accurately get to it's intended spot in FLOW pattern as it passes through the green phase.

Another purpose of multiple readouts on the same FLOW lane and run up would be to further clarify the readouts and provide possibility for mathematical enhancements, preprogrammed outputs and the like that could potentially reposition vehicles form a void or empty space into a FLOW pattern. Instead of running through a "partial" set of readouts where there would be a void, the readouts could continue, especially assigning traffic to the following FLOW pattern, so that all traffic has an opportunity to make it through on a green in spite of whether they may be near a node or not.

Multiples of the first node may also afford clarity in getting through on the green as well as minimize likelihoods of vehicles ending up in voids, blind spots, empty spaces or the like.

Vehicles that may have low tires and malfunctioning speedometers may benefit from an interactive readout that also includes the speed the vehicle is going as well as the speed to go. Products commonly known in the art such as Trackmaster® by Enforcement products take RADAR readings, do a double digit output could be fit in with an emplacemet and serve as such an output.

Emplaced FLOW readouts could serve to enhance greater systems and clarify their readouts. In a green wave, FLOW readout emplacements could center up the traffic in the wave. They could be posted as a lead in to a green wave system. In other types of complex systems, readout emplacements could clarify speeds to go in bi-directional green patterns and be coordinated with one another.

Actual hardware for the FLOW sequencer could take the form of a PLC type sequencer that is part of a RGY sequencer or just as easily, be a "parasite" unit that has its own timer that occasionally "checks" on timing updates from the "host" to make sure that there is minimum drift between each type of RGY, FLOW Pi matches. The FLOW sequences could come through a copper or fiber optic cable to the readout, or just as easily, be transmitted wirelessly by RF, RADAR, MASER, infrared, ultraviolet, visible light, LASER, or the like.

OBJECTS

It is an object of the present invention to provide for the method of informing individual vehicles which speeds to go in order to make it through the green phase on an upcoming traffic signal, to consolidate traffic into a moving pattern (a Fast Lane On Warning, or FLOW pattern) that proceeds through a traffic signal while it is green in phase.

It is another object to get traffic through without exceeding speed limit, and to not have cross-assignments.

Further it is an object to provide for the possibility of bringing traffic into compression in a manor somewhat proportional while in the net green phase (just before traffic goes through the traffic signal during green) to where they were when they were in a random string when they first started getting readouts.

Another object is to provide for traffic management that is simple to operate, that runs autonomously with easy reliable hardware.

Also, it is an object to provide for safety time buffers to absorb wayward traffic, stragglers and the like.

Another object is to provide for a way that traffic can get through a green part of the signal when that signal is first encountered as well as when that signal is in a series of signals that are far apart enough to be considered as first encountered.

Another object is to provide for a system that allows for traffic patterns that come through the same signal in opposing (perpendicular) directions to take turns going through the green phase: i.e. N-S traffic going through while green while E-W pattern is empty, then the E-W pattern going through green while the NS pattern is empty, and so on.

Another object is to provide for a system that can function autonomously as well as with capability of acting with manual or automatic such as in a traffic network green wave or the like.

Other objects will become evident as invention is further disclosed

DRAWINGS

A DESCRIPTION OF A PREFERRED EMBODIMENT

The following preferred embodiment is proposed for the purposes of disclosure and clarification. By no means and under no circumstances does it represent the only form the invention could take.

Figure 1:
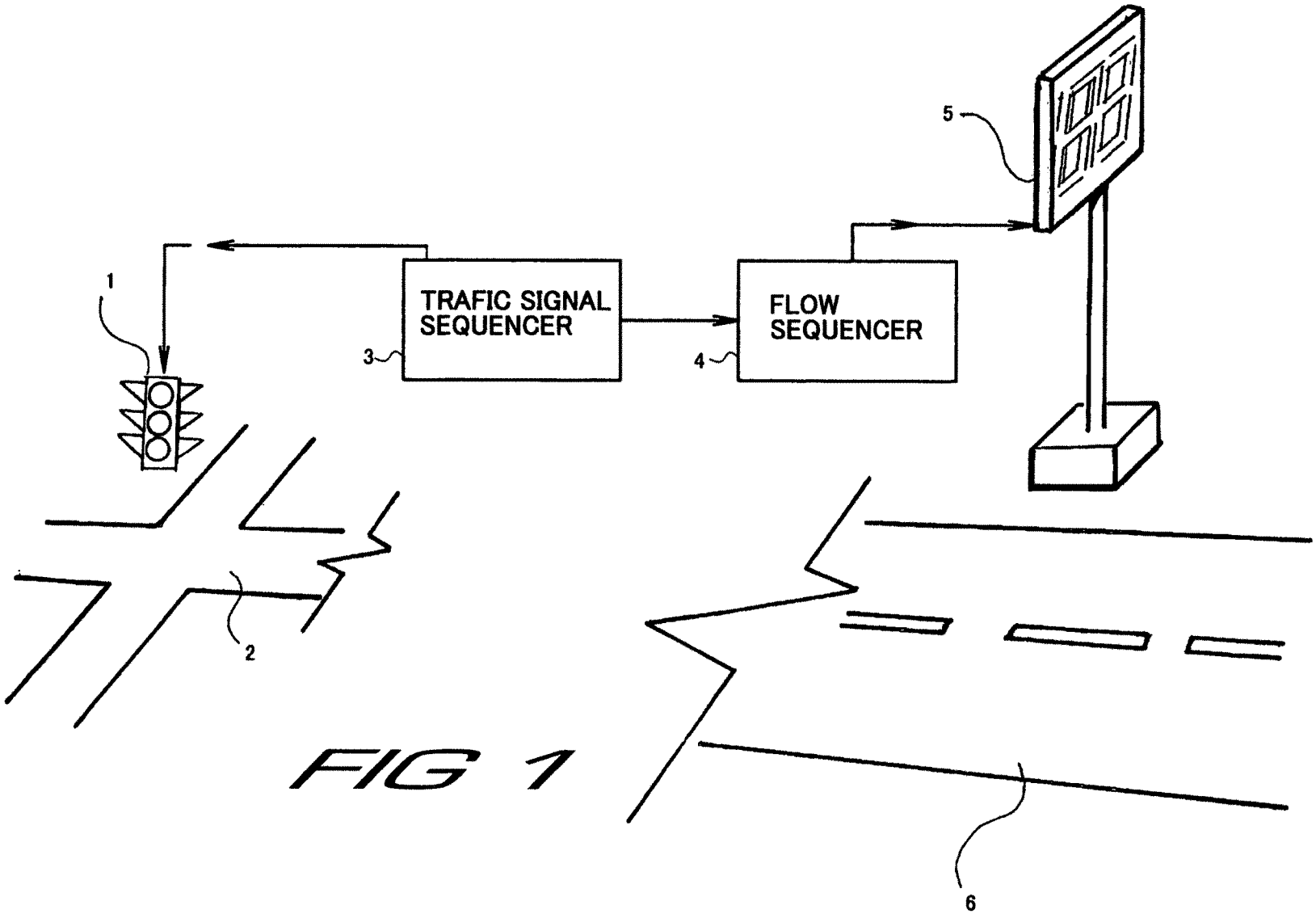
FIG. 1 shows details of main components including traffic light sequencer, flow sequencer and readout.
Figure 2:
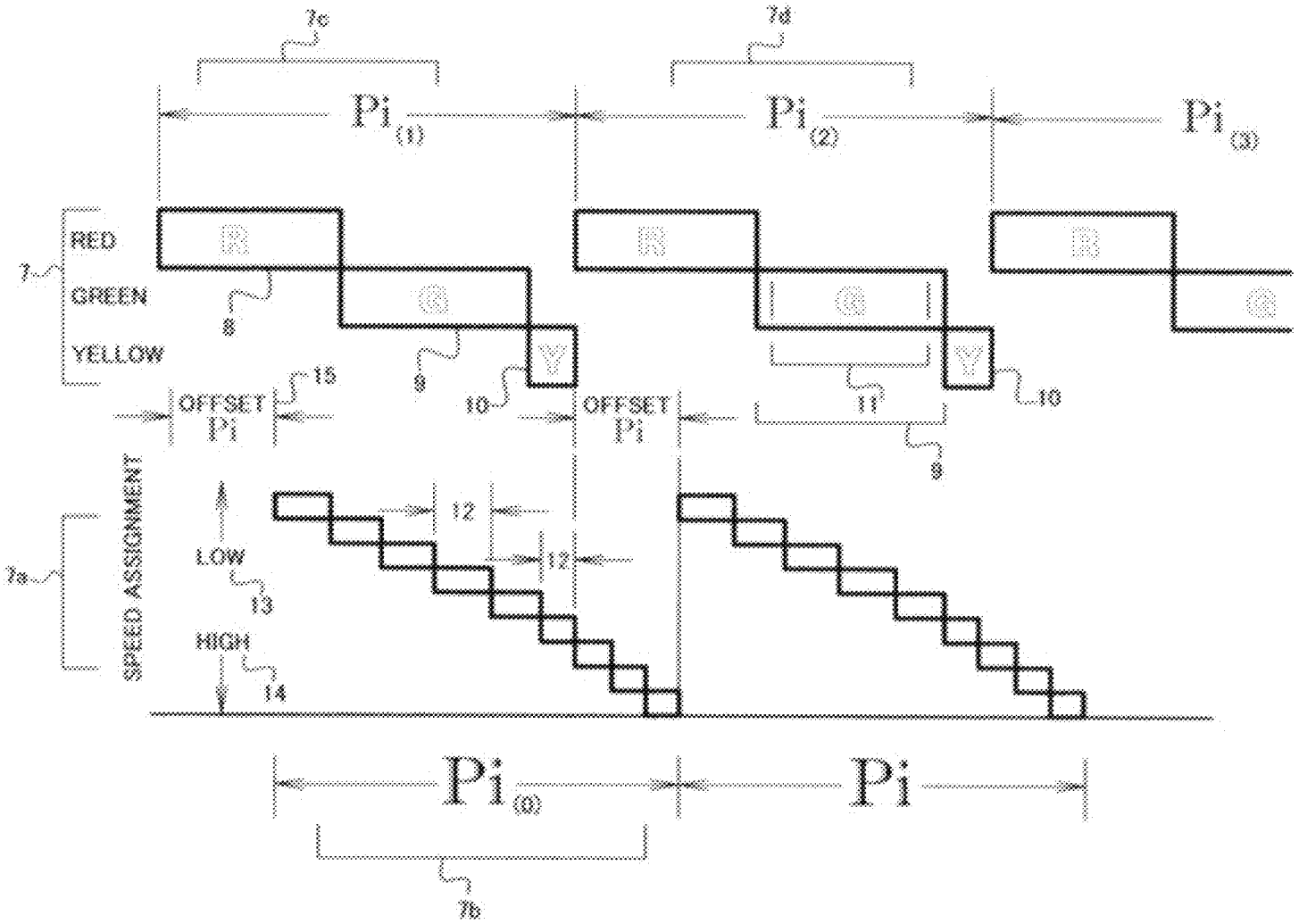
FIG. 2 shows traffic and FLOW sequencers as may be found in solid state device.
Figure 3:
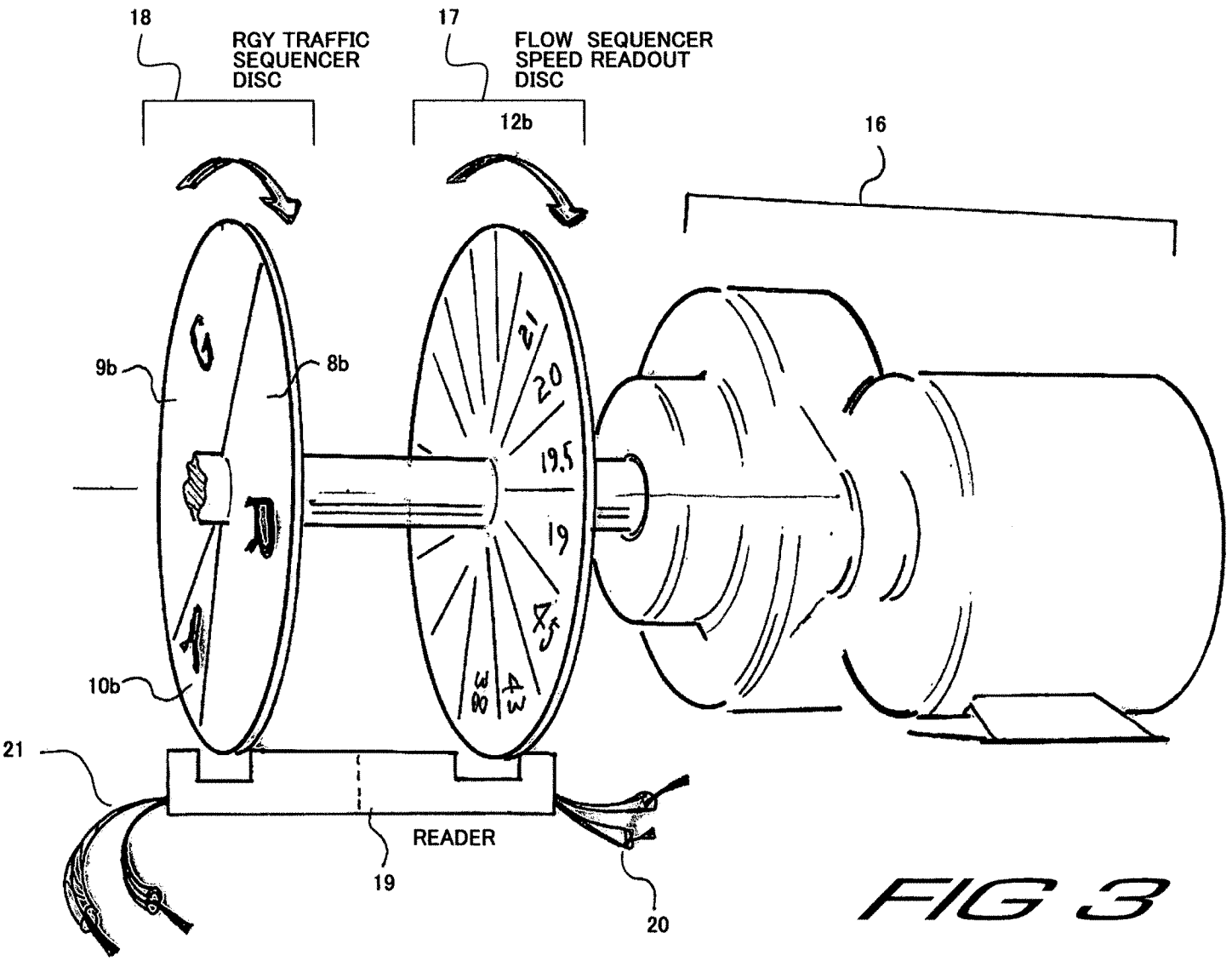
FIG. 3 shows theoretical model as well as a mechanical joint sequencer including motor, RGY disk affixed with speed readout disk.

In FIG [1] a traffic signal (1) controls intersection (2) being governed by traffic sequencer (3) which times itself with Fast Lane On Warning; FLOW sequencer (4) which sends sequences out to changing digits emplaced readout (5) a far distance away on roadway (6) while traffic "RGY" service cycle (7) has service cycle period Pi, that includes red cycle or phase (8), green cycle or phase (9) yellow cycle or phase (10), with a "net" green (11) being part of the green phase (9) in FIG. [2]. The same period Pi, 7*a* in [FIG. 2], is the sum of the FLOW sequences coming out as speed assignments (12) including linear range. Low speed assignments (13) range to high speed assignments (14). After considering cycle start offset (15), speed assignments of Pi-0 (7*b*) will correspond to net green phase of Pi-2 (7*d*), which happens while Pi-0 (7 *b*) overlaps Pi-1 (7 *c*). In FLOW wave projection (7*a*), Pi-0 (7 *b*) projects in with "present" Pi-1 (7 *c*).

Theoretical model of traffic phases and flow phases can be embodied in 3-dimensional sequencer including synchronous motor (16) turning at 1 or 2 RPM and affixed FLOW sequencer speed readout disc (17), and RGY traffic sequencer disc (18). Offset (15) in FIG. [2] is created by setting discs with respect of each other. As discs rotate having been driven by synchronous motor (16), they are read by stationary reference reader (19) reporting to speed output (20) and phase output (21). Pi is represented by 360 deg. rotating traffic sequencer disc (18) including phases R (8*b*) G (9*b*) Y (10*b*). Pi is represented by 360 deg. Rotating FLOW readout disc (17) which includes angular translations representing speed assignments (12 *b*) including angular range.

In FIG. [4] pre-consolidated random traffic pattern (22) is consolidated or compressed (23) into the breadth of length as well as time duration of Tng (11) such that green phase (9) includes forward safety buffer time space (24) and after safety buffer time space (25). Individual vehicles (26) do not exceed the speed limit, and do not get cross-assigned while this compression (23) takes place.

Also, as there is no cross assigning, vehicles (26) retain the same general position, proportion, place in the hierarchy during Tng (11) as they were in a previously random traffic pattern (22)

Figure 5:
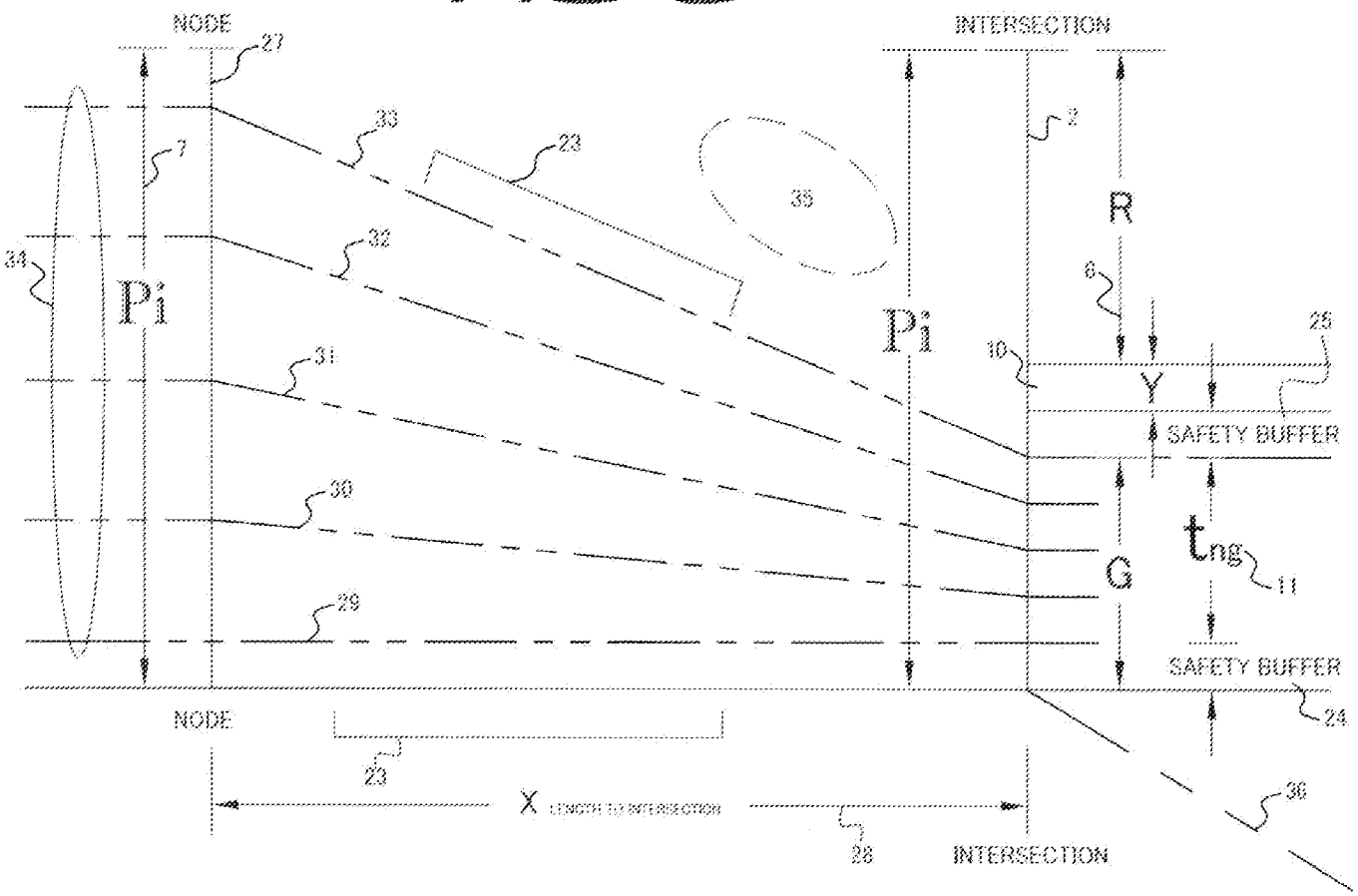
FIG. 5 shows chart of distance to intersection versus relative vehicle positions with respect to each other in space as well as time as they progress through the trap length and get compressed including service cycle Pi as it starts in a random pattern before compression to a developed pattern including "net" green Tng at intersection.

Consolidation is portrayed in more detail in [FIG. 5] where it begins at a node or threshold (27) and continues through the length of trap (28) and is shown as a trap distance length (horizontal) verses relative length of individual vehicles in pattern (vertical). Note that the vertical axis could just as easily portray relative time. Individual vehicles (29) through (33) trace themselves relatively with one another starting far apart, and randomly distributed throughout the pre consolidated flow pattern (34). They get closer together till they are adequately consolidated into net green Tng (11) leaving room for safety lead buffer (24) at intersection (2) leaving the red (8) and yellow (10) spaces and times clear of traffic. Time, and space that is void in trap is shown by void (35). Post compressed traffic already having gone through intersection (2) is allowed to go at a reasonable speed and spread out again (36).

Figure 4:
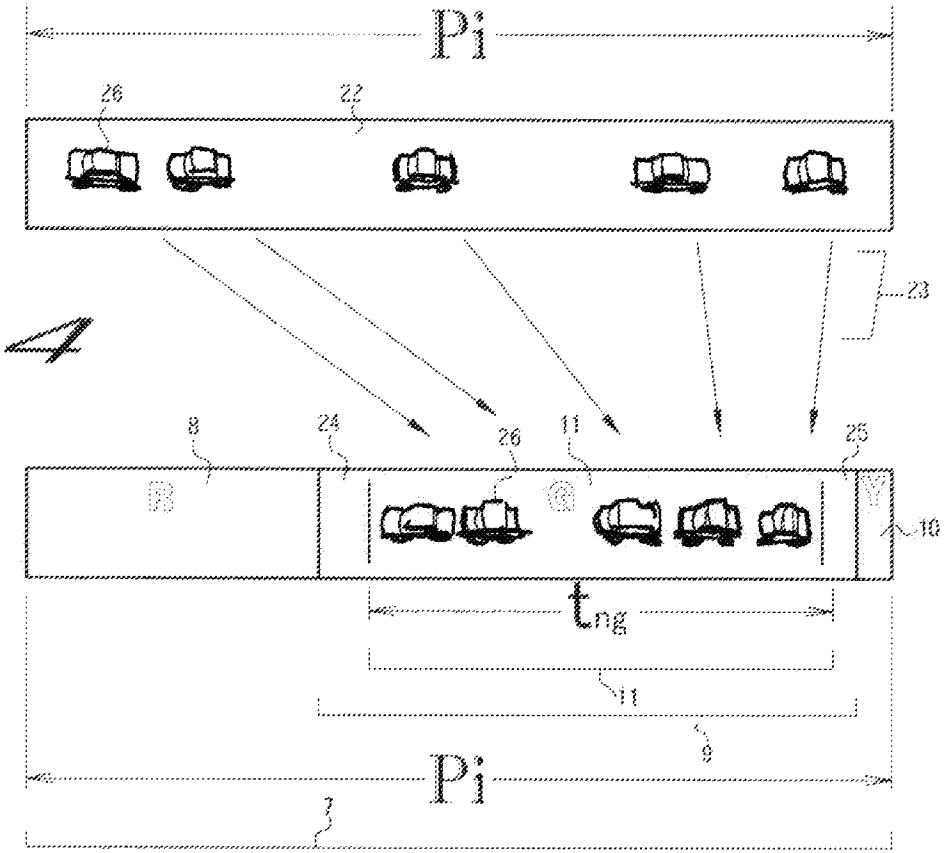
FIG. 4 shows random traffic pattern of length Pi versus traffic signal service cycle of Pi, including compression.

An overall view of the whole trap (28) is included in FIG. [6] with traffic signal (1) at one end of trap (28) and emplaced readout (5) at the node (27) on the other end of trap (28). Fully compressed pattern (37) goes through traffic signal in time and space of Tng (11) (in [FIGS. 2, 4, and 5]. Partially compressed patterns (38) still approach intersection (2). Pattern beginning to be compressed (39) begins to go over node (27).

Different FLOW traffic patterns (37, 38, 39) are shown taking turns such that (37) is going through during a green phase in East West direction while in the opposite direction: North and South, signal is showing red phase (8) and there is no traffic there (35) (in FIG. [5]). In that same opposite direction North and South (in FIG. [6]) partially compressed patterns (38) will arrive at signal (1) when it is in green phase. Thus, all vehicles (26 in [FIG. 4]) in each pattern taking turns can make it through on the green phase (9).

Figure 6:
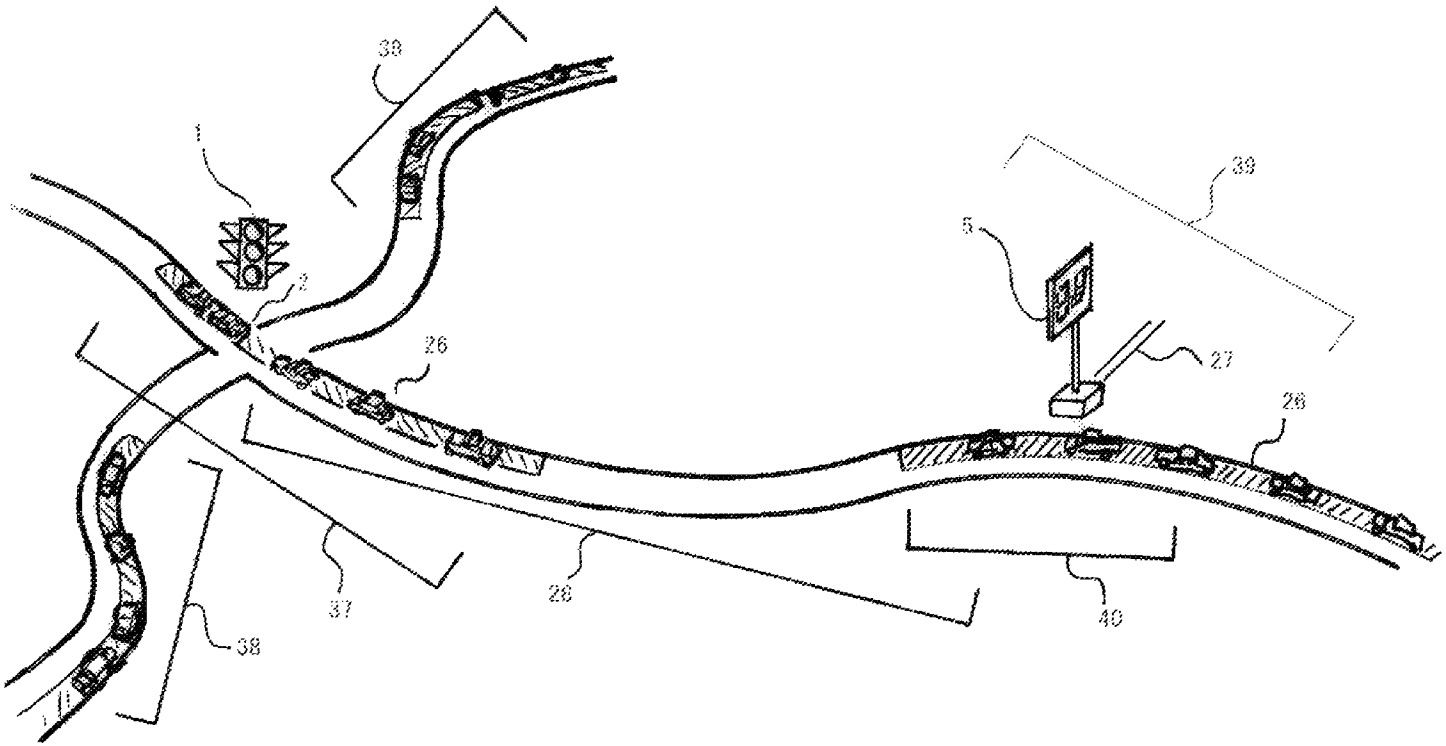
FIG. 6 shows spatial diagram including multiple flow patterns and physical locations of nodes and including traffic FLOW patterns taking turns going through green.
Figure 7:
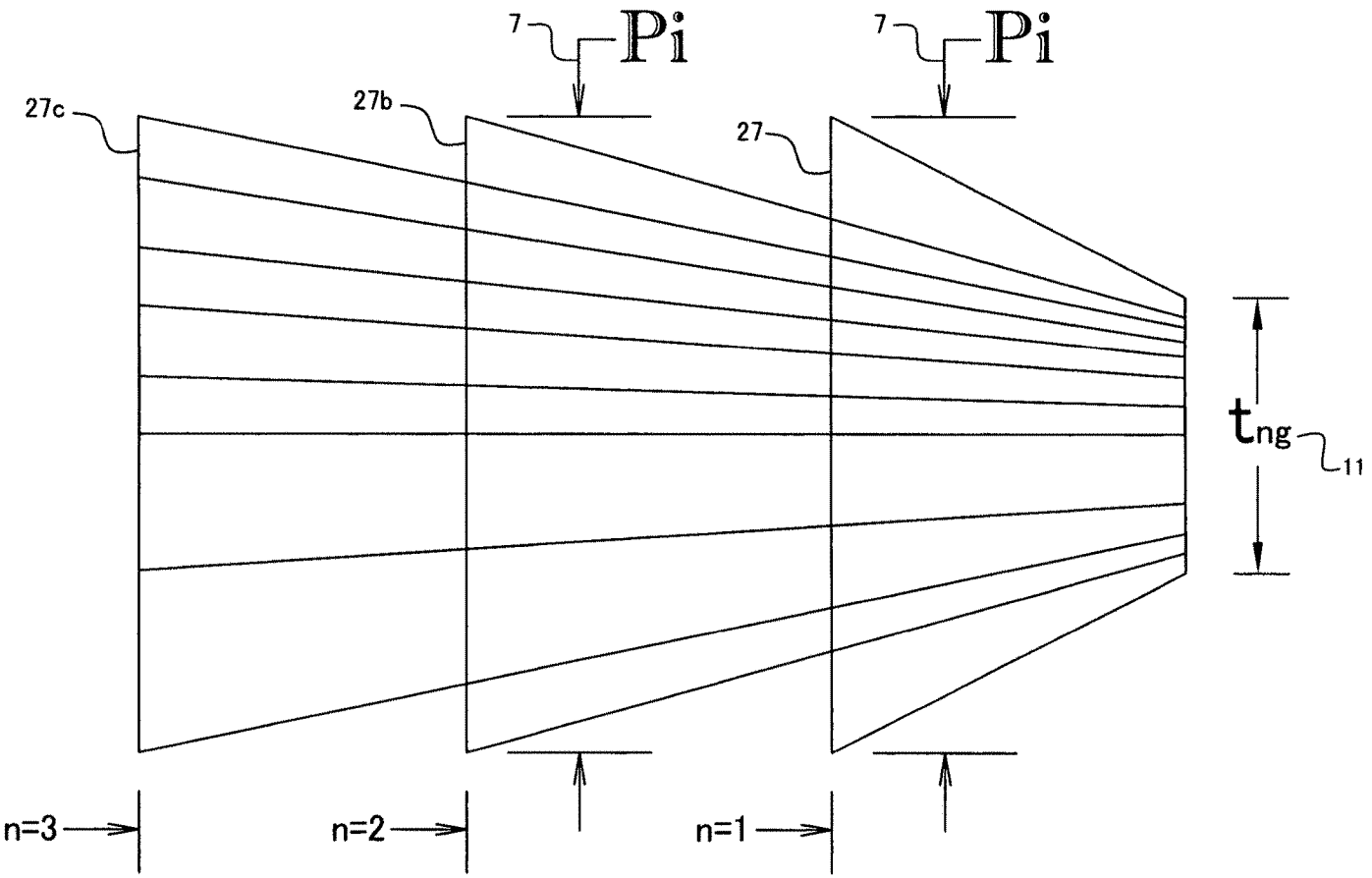
FIG. 7 shows use of multiple nodes.
Figure 8:
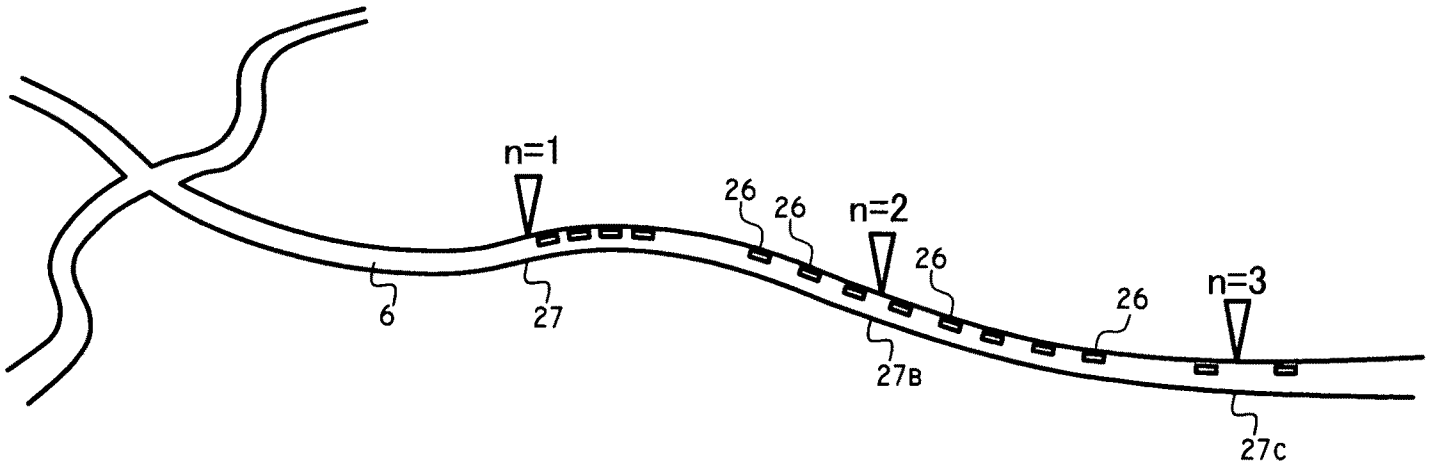
FIG. 8 shows map-diagram of multiple nodes including distances to intersection.
Figure 10:
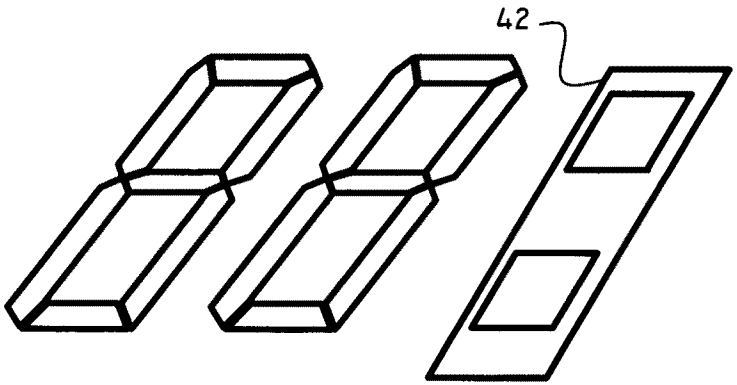
FIG. 10 shows alpha numeric readout with decimal bar graphic.
Figure 9:
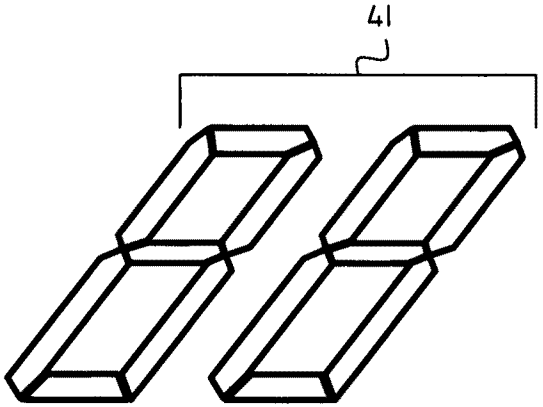
FIG. 9 shows alpha numeric read out.
Figure 11:
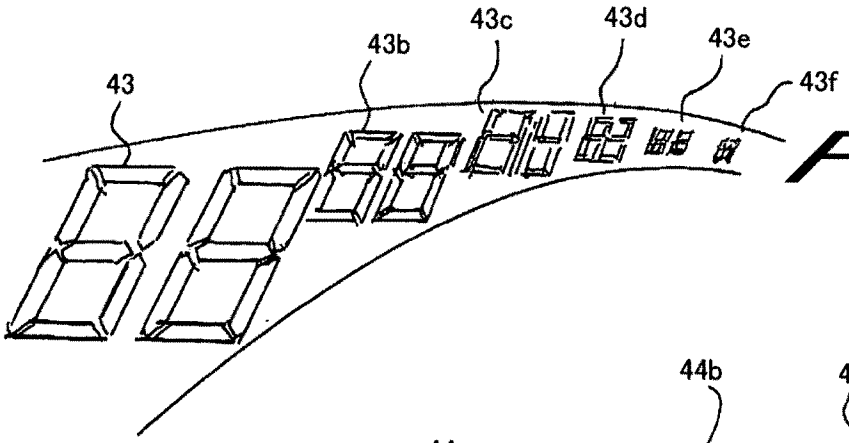
FIG. 11 shows multiple alpha numeric readouts.
Figure 12:
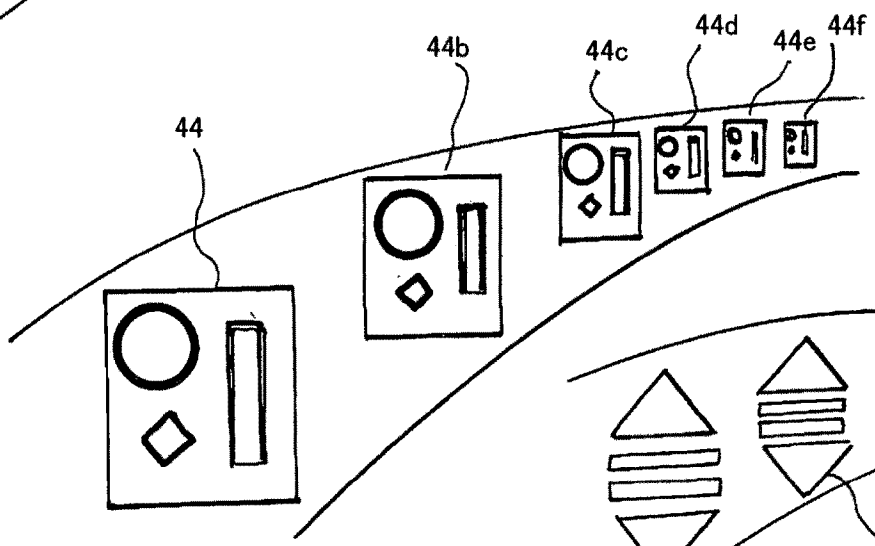
FIG. 12 shows multiple readouts showing graphics.
Figure 13:
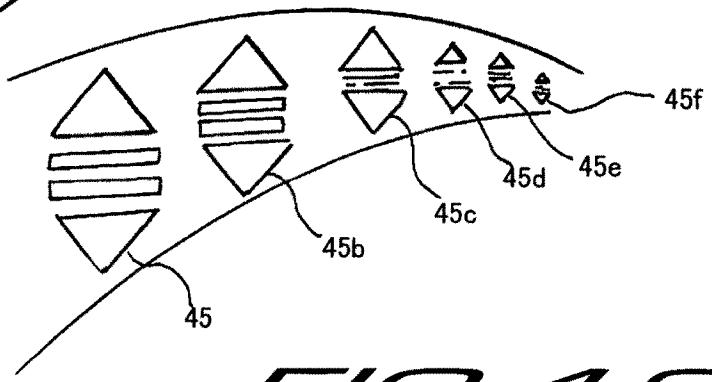
FIG. 13 shows multiple graphics morphing towards speed strips.

A non-distinct beginning of FLOW compression occurs at a node that is a range (40) instead of node as a point (27) in [FIG. 6].

Multiple nodes are shown in FIG. [7] that are equal products of (Pi*speed limit) that show concentrated traffic that focuses towards net green Tng (11). First node "n=1" (27) is closest; second closest node is "n=2" (27*b*), third closest node is "n=3" (27*c*), and so on . . . Tng (11) is projected against Pi (7) on the vertical axis. In FIG. [8] the same multiple nodes (27) for closest "n=1"; second one out "n=2" (27*b*), third one out "n=3" (27*c*) and so on, are shown on road (6) with vehicles (26) in random and partially compressing traffic.

The readout can take the form of a two digit sign (41) that changes to different readouts as shown in FIG. [9]. The speeds can be interpreted at a marker (not shown) by node (27). As it is passed, that speed can be taken as the assigned one to go at in order to make a green. To tighten the resolution, a graphic (42) can be integrated that implies the decimal. Multiple digital readouts (43), (43*b*), (43*c*), (43*d*), (43*e*), (43*f*) in FIG. [11] can correct for resolution issues. Also multiple graphics and semaphores (44), (44*b*), (44*c*), (44*d*), (44*e*), (44*f*) in FIG. [12] that are non numeric could help. In FIG. [13] up green arrows, triangles, or the like, down red arrows, triangles, or the like and middle white or green equal sign graphics (45), (45*b*), (45*c*), (45*d*), (45*e*), (45*f*) could serve or be combined with other signage to achieve higher resolution.

A traffic management system including a FLOW (Fast Lane On Warning) sequencer means operatively connected in conjunction with a traffic signal and sequencer said signal that controls an intersection. wherein said signal has a service cycle that is the sum of all its phases, including for example. Red+Green+Yellow=service cycle, (RGY), Pi, and with potential of including other phases including left turn, green arrow, walk, and wherein said FLOW sequencer also runs through repeating service cycle, Pi, that is the same as that of said traffic signal, wherein there is one or more lanes in the road leading up to said intersection (run up) in one or more directions that are covered by FLOW sequences, wherein said FLOW sequences are generated by the FLOW sequencer means and outputted as readouts in one or more emplacement/output means whose position includes being along the side of, or above road as "roadside units" (RSU) for each said FLOW lane, or trap, said emplacement output means being operatively connected to said FLOW sequencer means, wherein said FLOW readouts are perceived by individual motorists in said FLOW lanes, traps, so that motorists know which speed to go in order to make it through the light while it is green, wherein as a whole, traffic that was previously in a random string before encountering any FLOW readouts or speed assignments is compressed from a length of the product of the service cycle and the speed limit to a substantially shorter length that is the FLOW pattern or "platoon", that is full of traffic that proceeds through the intersection while the signal is open, or in green phase, wherein multiple lanes (FLOW lanes)which are given FLOW sequences running in the opposing (perpendicular) directions, can include the possibility of moving FLOW patterns taking turns going through their respective green phases, wherein an example would include North-South versus East-West, wherein if there is FLOW activity governing said opposing perpendicular directions, said opposing directional traffic can take turns going through same intersection at reasonably high velocities without having to come to a stop, wherein vehicles remain in somewhat the highest reasonable energy levels wherein increased mobility can be gained, and fuel consumption rate (and therefore emissions) can be reduced as a product of the infrastructure.

The system further comprises the connection means form sequencer to said readout means includes possibilities of cable means or wireless means.

The system follows reasonable parameters expected for the safety and mobility that that allow traffic to get through an open phase of said signal.

The system further comprises wherein there is essentially a starting, arrival time function Pa associated with arriving into area where traffic is managed, coordinated with and appropriately offset from said start of traffic signal RGY service cycle Pi, wherein Pi of the traffic signal and Pi of the FLOW sequencer means are starting at different times depending on the nature of the installation of said sequencer means. wherein there is a start or an arrival function that is between zero and said service cycle of traffic signal such that Pi >Pa >0, wherein said arrival function counts down from the service cycle period to zero, than starts at the service cycle again, wherein said arrival function repeats itself just like RGY and with the same period Pi.

The system further comprises wherein said parameters include: the non exceeding of speed limit (regardless weather it is the actual safe limit, or weather it includes additional safety velocity buffer of further reduced speed) during any kind of compression or consolidation. converging assignments. to the highest extent possible (i.e. to within the limitations of resolution), the discouragement of crossing of speed assignments wherein compression per unit time occurs on a previously random string of traffic, said string occurring in pre-road run-up, pre-FLOW compressions, pre trap, and wherein vehicles by virtue of assignments are not overtaking one another. approaching one another or the like, in the compression, consolidation period while said speed assignments are converging, the informing, compressing, consolidating of vehicles in a FLOW zone or trap, within substantially the same proportionate level they were in within the hierarchy as they were before compression in the random continuous strand of traffic, for example, vehicles arriving in the beginning in a random section will be at the beginning of a finally compressed, consolidated FLOW pattern; vehicles arriving at the middle of said random pattern before FLOW will be in the middle of the FLOW Pattern or "platoon" as it goes through the intersection; those at end of a random string of traffic before FLOW compression, will be at the end of said FLOW Pattern; a vehicle at the first 20% of said random traffic string will be substantially at 20% into said FLOW Pattern; same for a vehicle 67% into the random string as well as substantially 67% into ending FLOW and where all other proportions are substantially preserved between said random pattern and said finishing compressed FLOW pattern near said net green.

The system includes possibility forward and/or rear safety buffer time zones established in front of and in back of FLOW pattern wherein front zones allow for wayward traffic before said FLOW pattern include wayward late followers from previous FLOW pattern, waiting traffic to clear out and earlier arrivals, and said following buffer accounts for stragglers of the FLOW zone, as well as those vehicles who might turn onto the trap during a FLOW compression wherein FLOW compression and consolidation will be safer with said forward and afterward buffers, wherein said buffers that precede and follow FLOW pattern all summate to the green phase at the place of the intersection, and at the time of the green, so that the sum of each buffer and a "net" green Tng, add up to the green phase while said FLOW pattern is going through the intersection, wherein said net greens and before and after buffers can apply to other appropriate sub phases including left turn, green arrow, four-way-plus systems, wherein since vehicles of a FLOW pattern have to follow one another, that these buffer times and lengths: "space times" including each vehicle position plus its following distance in the hierarchy progress through the green phase in a "fed-in" or "aggregate" condition.

The system further comprises where there is an essentially node, or threshold that is defined on the closer side to said traffic signal/intersection as where compression is taking place, wherein converging speed assignments begin, and that is defined on the side of the inode, threshold farther from said signal/intersection as the region before compression and speed assignments begin, where:

A. the node could be like a reference point given by X where speed limit and substantially half speed limit (although allowing for variation of yellow, pedestrian, green arrow, left turn or the like adjusting it away from exactly half, thus making net green smaller) would coincide, B. or X=Pi*speed limit, C. or X=(Pi/(1/slow speed −1/fast speed)), D. or given by a place where Pi and (2*Pi/2) coincide, E. or any combinations of A through D.

The system further comprises wherein the following relationship substantially dictates activity within the FLOW zone:

$$Vsa = \frac{X}{(Pi - Pa) + Pi + pgS - \left[1 - \frac{(Pi - Pa)}{Pi}\right]Tng}$$

where:

Vsa=speed assignment,

X=distance to intersection,

Pa=arrival point in time that vehicle enters trap,

Pi=service cycle period of intersection, pgS=pre green safety time buffer period, Tng=net green period where compressed FLOW traffic is intended to go through.

The system further comprises wherein there can also be a following safety buffer time zone wherein it is created by further shrinking Tng wherein safety following buffer time is created by Tsf=G −pgs −Tng, where Tsf is period of safe following such that G»Tsf.

The system if claim 8 wherein said Tng can be made smaller and smaller until Tng turns to zero, then the wherein the term $$''-\left[1 - \frac{(Pi - Pa)}{Pi}\right]Tng''$$

drops out and the zone of Tug becomes a point, wherein placement of said point can be determined by how big the setting is for pgS, pre green safety time buffer period, wherein said target point, as well as small Tng space time can serve to clarify readouts to gain resolution and discourage low resolution assignments causing vehicles to miss said green phase.

The system of claim 8 wherein there can be multiple nodes, wherein X and Pi are multiplied by the same factor "n" wherein:

$$Vsa = \frac{(n)X}{(Pi - Pa) + (n)Pi + pgS - \left[1 - \frac{(Pi - Pa)}{Pi}\right]Tng}$$

wherein said multiple nodes can be further up said roadway, wherein there can be a possibility that said multiple nodes are multiple numbers of the first node (1)X, and can be expressed as (2)X, (3)X, (4)X, (5)X and so on.

The system further comprises wherein said FLOW sequencer means shares the possibility of being integrated with said traffic signal. wherein there is also the possibility that said FLOW sequencer means comes as a substantially autonomous unit, wherein said autonomous version can include its own timing means, with the possibility of said autonomous FLOW sequencer being piggy backed to an existing traffic sequencer in parasite condition, wherein there is the possibility of said autonomous FLOW sequencer means running on its own Pi and taking often or occasional corrections, updates, calibrations from said RGY sequencer, wherein FLOW systems can be added to existing infrastructure instead of having to replace it.

The system further comprises wherein there are multiple readout means or output devices, emplacements on the same FLOW lane or trap.

The system further comprises wherein there can be mathematical enhancements or manually programmed inputs applied to empty spaces, voids, or places and times where there are not normally any FLOW outputs, wherein those vehicles within those normally non-speed-assigned times and places can be provided for, and still have opportunity to gain access to FLOW pattern, wherein vehicles in normally non-assigned times and places can still be directed to a FLOW pattern and make it through the green light without having to stop, wherein said vehicles will not be given assignments to cause said vehicles to exceed the speed limit, wherein said vehicles will not be given cross assignments, or assignments that would cause said vehicles to pass one another as best to the limitations of resolution, wherein as best as possible that mathematical enhancements assigning traffic into said time (space) buffers, will do so on a basis that is proportional to their position at first encounter.

The system further comprises wherein said relationship can apply to multiple Tng within the same Pi, with examples including net green for going straight, a different net green (net green arrow) for left turn, for right turn.

The system further comprises wherein said FLOW sequencer means can respond to automatic or manual inputs.

The system applies to appropriate allied traffic management applications including intersections with vehicles on tracks, busses, trams, trollies, marine, bicycle, walking, pedestrian.

The system further comprises wherein RSU; emplacement: output means; readout means includes possibility for being changeable sign means.

The system further comprises wherein said changeable sign means includes possibility of being a sign including two digits alphanumeric that change as FLOW readouts go through their cycles, wherein said changeable sign means can easily be seen and distinguished by passing motorist.

The changeable sign means further comprises wherein readout means includes graphics, colors. semaphores, wherein said readout means may be easier to interpret and understand.

The changeable sign means further comprises wherein said changeable sign means is interactive.

The interactive changing sign means further comprises possibility for output of assigned speed compared to actual speed that vehicle is going, and wherein in vehicle's speedometer is imprecise or malfunctioning, said vehicle can still attain optimal proportional position in FLOW pattern hierarchy.

The system further comprises wherein emplacement means, FLOW sequencer means, changing output means can be integrated with larger systems including regionally coordinated traffic systems, centrally controlled traffic networks, coordinated traffic networks, green waves traffic networks, autonomous traffic networks, multiple signal controlled and autonomous systems and networks, wherein said larger systems can be more clearly defined and with better moving-traffic-greentime utilized as well as better output for motorist to understand.

What is claimed is:

1. A traffic management system comprising:

a surrounding roadway to an intersection; a reasonable inflow of incoming traffic, comprising of vehicles driving towards said intersection; further comprising a run-up as some road leading up to where traffic managing takes place, said roadway comprising one or more lanes from one or more directions; a trap which is substantially a zone where traffic managing of said traffic management system takes place; a node wherein said node is the threshold, either a point or range, between where said traffic is incoming and randomly distributed, and where said traffic managing takes place, wherein a physical layout of infrastructure geometry of said traffic management system progresses outwards from said intersection as follows: said intersection; said trap; said node; said run-up, a traffic signal that governs said intersection;

a traffic signal controller operatively connected to said traffic signal, wherein said traffic signal continuously runs through repeating cycles substantially comprising of at least red, green, yellow phases wherein said red, green, yellow phases add up to a service cycle substantially represented by one summated-phase-completion of said traffic signal, P(i); wherein said service cycle is substantially the sum of:

red phase+yellow phase+green phase=P(i)=service cycle, wherein said service cycle P(i) includes types of phases represented by the group that includes red, green, yellow, green arrow-right-turn, green arrow-left-turn;

a network of at least one roadside unit wherein said roadside unit represents equipment apparatus emplaced to be easily identified by motorists representing said vehicles that are approaching said intersection, wherein said roadside unit comprises at least a changeable sign;

the traffic management system further comprising use of HEADWAY reference wherein said headway is represented by either LENGTH, TIME or BOTH, wherein said length is measured between, traveling vehicles, wherein headway-involved-time is measured by time periods between said vehicles' passing a static reference point along said roadway, wherein under said reference of HEADWAY, said P(i) cycle represents a period of time with a beginning point, an end point such that when P(i) cycles are stranded together by attaching said end points to said beginning points, said cycles form a repeating P(i) cycle time-continuum, wherein said P(i) cycle time-continuum ALSO APPLIES as being laid out as a moving physical length continuum with cycle lengths of same said P(i) time cycles attached similarly in P(i) length cycles, end-to-beginning, wherein said length continuum is traveling at constant velocity towards said intersection, the traffic management system further comprising use of PATTERN reference wherein said pattern comprises of a group of said vehicles moving towards said intersection, wherein said pattern starts out as a random distribution of said reasonable inflow of said vehicles, approaching said intersection, substantially at the posted speed limit, wherein said pattern evolves undergoing changes depending on what states said pattern is in traffic management from being a vehicle distribution at full P(i) length as well as full P(i) time period at period before traffic managing takes place (pre-managing), to substantially having the entire population of said vehicles in said pattern within said green phase by the time said pattern goes through said intersection, traffic signal, the traffic management system further comprising a sequencer apparatus operatively connected to said traffic signal which produces, in coordination with said traffic signal, sequences for the purpose of sending said sequences out to approaching vehicles in said one or more lanes of road in one or more directions approaching said traffic signal, said intersection;

wherein said roadside unit conveys said sequences as readouts through said changeable sign, wherein said sequences as well as said readouts stream out as a readout continuum associated with said repeating traffic signal cycle, the traffic management system further comprising apparatus wherein said readouts direct said vehicles in said random pattern in said P(i) length to be COMPRESSED to within said green phase by the time said pattern goes thru intersection, wherein said pattern goes through said intersection substantially without stopping, the traffic management system further comprising apparatus wherein said readouts direct said vehicles to COMPRESS, wherein said compress is further defined as at least one of the following: a) by said vehicles' being directed not to exceed posted speed limit, b) wherein said vehicles are being directed to maintain order, wherein individual said sequences, said readouts expresses as said readout continuum of repeating, ascending, phases, wherein said readouts cause said individual vehicles to provide for organizing of group behavior of said pattern in relationship to said P(i) length, the traffic managing system further comprising apparatus that directs said vehicles grouped as a said pattern to undergo said traffic management using at least the following four states:

State 1 (pre-managing state):

a) wherein said pattern approaches said intersection from substantially far away from said intersection, substantially within and/or farther away from said run-up place;

said readout continuum corresponds to said repeating P(i) cycle time-continuum while said readout continuum is outside traffic management;

b) wherein at this present state, said pattern substantially corresponds to said P(i) time and/or length, wherein said pattern is populated with said vehicles in RANDOM DISTRIBUTION;

c) wherein said pattern is in a condition of said pre-managing;

State 2 (transitional state):

a) taking place at said NODE b) transitioning from said random approach to said traffic managing;

while said pattern crosses said node, said pattern begins to undergo compression, wherein said readouts direct said vehicles to vacate said yellow and red phase part of said P(i) and populate said green phase part so that by the time said pattern drives through said intersection all said vehicles of said P(i) would substantially go through said traffic signal during green phase;

c)corresponding to where said run-up transitions into said trap;

d) wherein said pattern is in a condition of transition between said pre-managing and traffic managing states as said pattern goes over said node;

State 3 (traffic managing state):

a) takes place in TRAP;

b) said readouts direct vehicles in said pattern so that pattern gets COMPRESSED from said P(i) length wherein said population of said vehicles that was randomly distributed and/or whole length of said P(i), is getting shorter in time and length;

while said pattern crosses through said trap, said readouts directed said vehicles to vacate said yellow and red phase part of said P(i) and populate said green phase part so that by the time said pattern drives through said intersection all said vehicles of said P(i) would substantially go through said traffic signal during green phase;

wherein said traffic managing is conducted to said vehicles following said readouts through said roadside unit through said changeable sign;

c) corresponding to where a previously random pattern that was distributed over said P(i) length is compressed to at least within said green phase by the time said pattern reaches said intersection, while between said transition state (State 2) and a going through intersection state (State 4);

d) in a condition of: compression;

State 4 (going through intersection):

a) substantially taking place in locale of said intersection;

b) traffic has been substantially managed; said pattern is now compressed so that substantially whole said pattern travels through said green phase of said traffic signal while moving;

while said yellow and red phase of said P(i) is now empty, said green phase part of said P(i) is now substantially fully populated with said vehicles;

wherein said pattern, that was randomly distributed throughout said P(i) length during said state 1 (pre managing state), is now substantially compressed to within said green phase;

c) corresponding to substantial end of said traffic managing;

d) wherein said whole pattern is in condition of going through said traffic signal, and without having to stop;

the traffic management system further comprising apparatus wherein said trap length is mathematically expressible as the product of the service cycle P(i) and the speed limit: P(i)*SL=L (where P(i) is service cycle period of said traffic signal, SL is speed limit, L is length).

2. The traffic management system of claim 1 wherein said green phase further comprising net green and safety time buffer.

3. The traffic management system of claim 1 wherein said changeable sign further comprises two alphanumeric digits that change as said readouts go through said cycle, wherein said changeable sign can easily be seen and distinguished by passing motorist, wherein said readouts substantially autonomously progress through said sequences, wherein said readouts substantially represent converging SPEED ASSIGNMENTS, wherein said converging speed assignments cause individual vehicles to get closer to one another so that said P(i) length and/or time duration compresses pattern to green phase length and/or time duration by the time said pattern goes through said traffic signal.

4. The traffic management system of claim 1 further comprising a changeable sign, visible from said vehicles while passing, wherein readout of said sign is represented by the group that includes graphics, colors, semaphores, wherein said changeable sign runs through multiple images, wherein said changeable sign is appropriate graphic or semaphore readout that organizes traffic from said P(i) length.

5. The traffic management system of claim 1 further comprising apparatus for transmitting said sequences between said traffic signal controller, and said roadside unit that is either wireless, cable or both, wherein at least one of the following conditions take place:

a) the function of transmitting said sequences through said roadside unit is done through wireless apparatus, as represented by the group that includes RF, RADAR, b) the function of transmitting said sequences through said roadside unit is done through cable apparatus as represented by the group that includes copper cable, fiber optic cable.

6. The traffic management system of claim 1, further comprising apparatus that manages traffic wherein said readouts direct said vehicles to CONSOLIDATE, wherein said consolidate is further defined as at least one of the following:

a) the non exceeding of speed limit, wherein the posted speed limit is not exceeded, wherein an actual posted safe speed limit is the posted speed limit in regions around said traffic signal and intersection, b) the discouragement of crossing of speed assignments, wherein said crossing of assignments would be further defined as where a vehicle with one assignment would be compelled, via said speed assignments, to overtake or pass a vehicle with another different assignment anywhere within said trap or wherever traffic managing takes place, c) the substantial maintaining of the same order of vehicle in said pattern as the pattern compressed, wherein during action of compressing of said vehicles in said trap takes place wherein said vehicles remain within substantially the same order when in before compression took place.

7. The traffic management system of claim 1 wherein the following relationship substantially dictates activity within said trap:

$$Vsa = \frac{X}{(Pi - Pa) + Pi + pgS - \left[1 - \frac{(Pi - Pa)}{Pi}\right]Tng}$$

where:

Vsa=speed assignment

X=distance to intersection

Pa=arrival point in time that vehicle enters said trap

P(i)=service cycle period of intersection pgS=pre green safety buffer time period Tng=net green period where compressed traffic is intended to go while said pattern goes through said intersection.

8. The traffic management system of claim 7 further comprising a following safety buffer time period, wherein said safety buffer time period created by shrinking T(ng), wherein said following safety buffer time period is created by Psf=G −pgS −T(ng), wherein Psf is said following safety buffer time period, G is green phase and T(ng) is said net green period.

9. The traffic management system if claim 7 wherein said T(ng) can be made smaller and smaller until T(ng) turns to zero, then wherein the term "−[1−(a)]Tng" drops out and the zone of T(ng) becomes a point, wherein placement of said point can be determined by how big the setting is for pgS, pre green safety time buffer period.

10. The traffic management system of claim 7 further comprising use of multiple nodes, wherein X and P(i) are multiplied by the same factor "n" wherein:

$$Vsa = \frac{(n)X}{(Pi - Pa) + (n)Pi + pgS - \left[1 - \frac{(Pi - Pa)}{Pi}\right]Tng}$$

wherein said X represents a said trap length, (n)X represents multiple nodes, trap lengths placed further up said roadway, wherein said multiple nodes are represented by whole numbers of the first node (1)X, and would be expressed as (2)X, (3)X, (4)X, (5)X and so on.

11. The traffic management system of claim 1 wherein said sequencer comprises at least one of the following: a) of being integrated with said traffic signal controller, b) that said sequencer remains as a substantially autonomous unit, as in a piggy back or parasite condition with said traffic signal controller, wherein said autonomous version includes at least one of the following: utilizing timing means of said substantially autonomous sequencer apparatus, b) utilizing timing of said traffic signal controller, c) or a combination of these.

12. The traffic management system of claim 1 further comprising multiple units of said roadside unit are placed within said trap.

13. The traffic management system of claim 2 further comprising apparatus that allows said sequencer the ability for at least one of the following: A. being able to respond to automatic inputs, B. being able to respond to manual inputs.

14. The traffic management system of claim 1 as it applies to appropriate allied traffic management applications including intersections with vehicles on tracks, buses trams, trolleys, marine, bicycle, walking, pedestrian.

15. The traffic management system of claim 1 further comprising apparatus wherein said changeable sign is interactive, wherein feedback is given to said vehicles as to what speed said vehicles are going as well as said readouts from said changeable sign.

16. The traffic management system of claim 1 wherein said changeable sign further comprises two alphanumeric digits that change as readouts go through said cycles, further comprising interactive changing sign apparatus, wherein said interactive apparatus is a comparison readout of actual speed vehicle is going to readout of said speed assignment.

17. The traffic management system of claim 1 further comprising of said system being integrated in with larger systems, wherein said integration involves any or all of the following: said roadside unit; said sequencers; said changeable signs; said readouts, wherein said larger systems further comprise of any or all of the following: A. regionally coordinated traffic systems, B. centrally controlled traffic networks, C. coordinated traffic networks, D. green waves traffic networks, E. autonomous traffic networks, F. multiple signal controlled networks, G. autonomous systems and networks.

18. The traffic management system of claim 1 further comprising an apparatus wherein said vehicles of said pattern follow one another wherein each vehicle has position of said vehicle as well as headway of said vehicle in a hierarchy that progresses through said intersection in said green phase in a fed-in condition.

* * * * *